United States Patent [19]

Bulso, Jr. et al.

[11] Patent Number: 5,024,077

[45] Date of Patent: Jun. 18, 1991

[54] METHOD FOR FORMING CONTAINER WITH PROFILED BOTTOM

[75] Inventors: Joseph D. Bulso, Jr., Canton; James A. McClung, North Canton, both of Ohio

[73] Assignee: Redicon Corporation, Canton, Ohio

[21] Appl. No.: 345,477

[22] Filed: Apr. 28, 1989

Related U.S. Application Data

[63] Continuation-in-part of Ser. No. 141,826, Jan. 11, 1988, Pat. No. 4,826,382.

[51] Int. Cl.[5] ..... B21D 31/02; B21D 51/44

[52] U.S. Cl. ..... 72/336; 72/329; 72/348; 413/1; 413/69; 413/76

[58] Field of Search ..... 413/1, 69, 76; 72/329, 72/348, 336

[56] References Cited

U.S. PATENT DOCUMENTS

| | | | |
|---|---|---|---|
| 3,685,338 | 8/1972 | Hoffman | 413/1 |
| 3,695,084 | 10/1972 | Siemonsen et al. | 72/348 |
| 3,855,862 | 12/1974 | Moller | 413/1 |
| 3,902,347 | 9/1975 | Ridgway et al. | 72/336 |
| 4,010,867 | 3/1977 | Jones | 220/66 |
| 4,051,707 | 10/1977 | Valek et al. | 72/348 |
| 4,120,419 | 10/1978 | Saunders | 220/66 |
| 4,439,081 | 3/1984 | Holk et al. | 413/1 |

*Primary Examiner*—Frederick R. Schmidt
*Assistant Examiner*—Jack Lavinder
*Attorney, Agent, or Firm*—Reese Taylor

[57] ABSTRACT

A method of forming a container body having a profiled bottom in a continuous operation wherein the body is formed from a blank of material into an inverted cup, the cup is reverse drawn and a preliminary profile is imparted to the bottom of the cup, and a final profile is imparted. The apparatus includes a die cut edge movable into telescoping relationship around a redraw die to form the inverted cup and a profile punch movable into telescoping relationship within the redraw die to form the preliminary profile against a profile pad. The profile pad is selectively supported by a pair of fluidly actuated pistons whereby, upon activation of the second piston, the final profile may be formed.

5 Claims, 13 Drawing Sheets

METHOD FOR FORMING CONTAINER WITH PROFILED BOTTOM

RELATED PATENT APPLICATIONS

This application is a continuation-in-part of Applicants' earlier filed application, Ser. Number 141,826, filed Jan. 11, 1988, and now U.S. Pat. No. 4,826,382

FIELD OF THE INVENTION

This invention relates in general to the art of forming containers and relates in particular to the improved forming of bottom profiles on two-piece containers.

DESCRIPTION OF THE PRIOR ART

In the container industry in general, and in the food container industry in particular, it is often desired to impart a bottom profile to the container for purposes of strength. These profiles include one or more annular rings or recesses in the bottom which, of course, improve the buckle strength of the end.

Some examples of representative profiles can be seen in Jones U.S. Pat. No. 4,010,867; Saunders U.S. Pat. No. 4,120,419 and Holk U.S. Pat. No. 4,439,081.

In the prior art, it has generally been known to form two-piece containers to essentially their final cylindrical configuration having a sidewall and bottom and then to impart a "preform" profile to the bottom at a first station. This is accomplished by utilizing a suitable die core and die with a profile pad inserted therein.

The container is then moved to a second station either in the same press or in another press wherein the bottom will be hit again to "reform" or deepen the profile to its final depth. The primary purpose of transferring the container and utilizing a two station operation is to relieve the back tension on the sidewalls during the reform operation. In other words, during the reforming or resetting of the bottom profile, it is desirable to minimize the distance which the metal has to be pulled from the sidewall to finally form the bottom profile so as to avoid damage to the container which can be so severe as to tear the bottom out of the container.

This is because it is extremely difficult to pull around the sharp edges of the forming tools and impart a deep profile, particularly if the material has to be pulled any distance down the sidewall area of the container. Therefore, the two station approach results in pulling the material a lesser distance in any single operation. The obvious disadvantage, however, is that this approach requires handling the container twice and also requires the provision and utilization of transfer equipment.

SUMMARY OF THE INVENTION

It has been discovered, therefore, that these disadvantages can be eliminated and the entire profiling operation can be performed at a single station without risking damage or even destruction of the container.

In furtherance of that goal, it has been found that an effective, relatively deep profile can be formed in the bottom of a two-piece container by first providing an inverted cup and then reverse drawing the cup to a slightly overlength condition while setting the preliminary or "preform" profile, following which the bottom profile is finally set by folding the excess material up into the bottom. It has been found that this can be accomplished in one continuous operation at one station without the need to transfer the container.

Elimination of the back tension on the material is achieved primarily by the utilization of a two piston support for the profile pad wherein both pistons support during the initial forming and during the reforming.

It has been found that, in this fashion, the entire profiling operation can be accomplished in one station without the risk of damaging or destroying the container and, of course, without the difficulty and expense of transferring the container from one station to another in order to accomplish the complete profiling operation.

It, accordingly, becomes the principal object of this invention to produce a container with a profiled bottom by the method and apparatus just described with other objects hereof becoming more apparent upon a reading of the following brief specification considered and interpreted in view of the accompanying drawings.

BRIEF DESCRIPTION OF THE PREFERRED EMOBODIMENT

Figure 1:
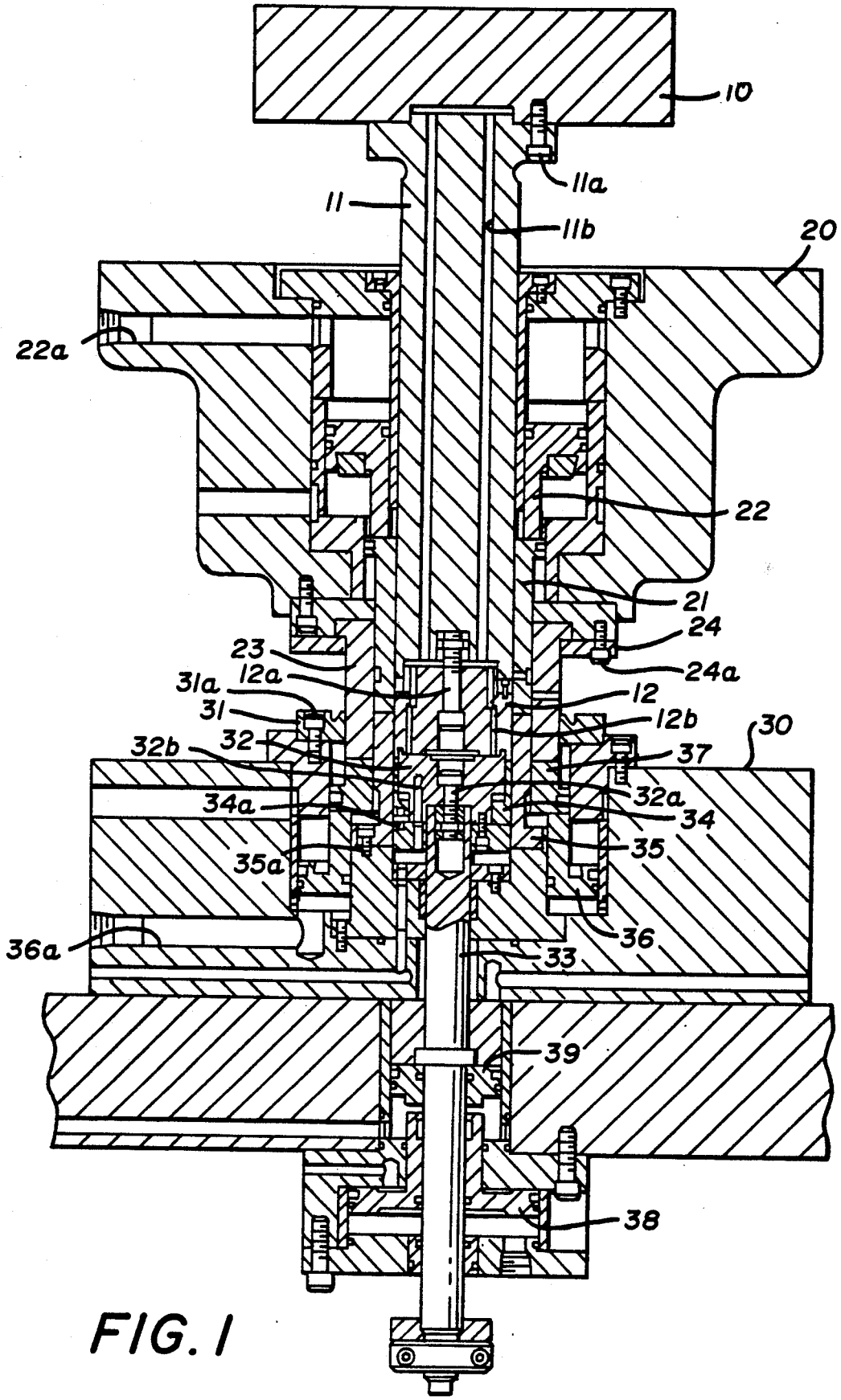
FIG. 1 is an elevational assembly view, partially in section, showing the position of the apparatus just prior to final forming.

Referring first to FIG. 1 of the drawings, it will be noted that the apparatus of this invention and the method of operating that apparatus is intended to be practiced in conjunction with a double acting press of the type generally shown in Ridgway U.S. Pat. No. 3,902,347. That patent discloses, in some detail, a press of the general type intended to be employed and, generally speaking, it can be said that such a press has inner and outer slides to which tooling can be attached and which are capable of reciprocating with respect to a fixed base and which are also capable of being independently controlled as to phase angle and shut heighth.

Figure 2:
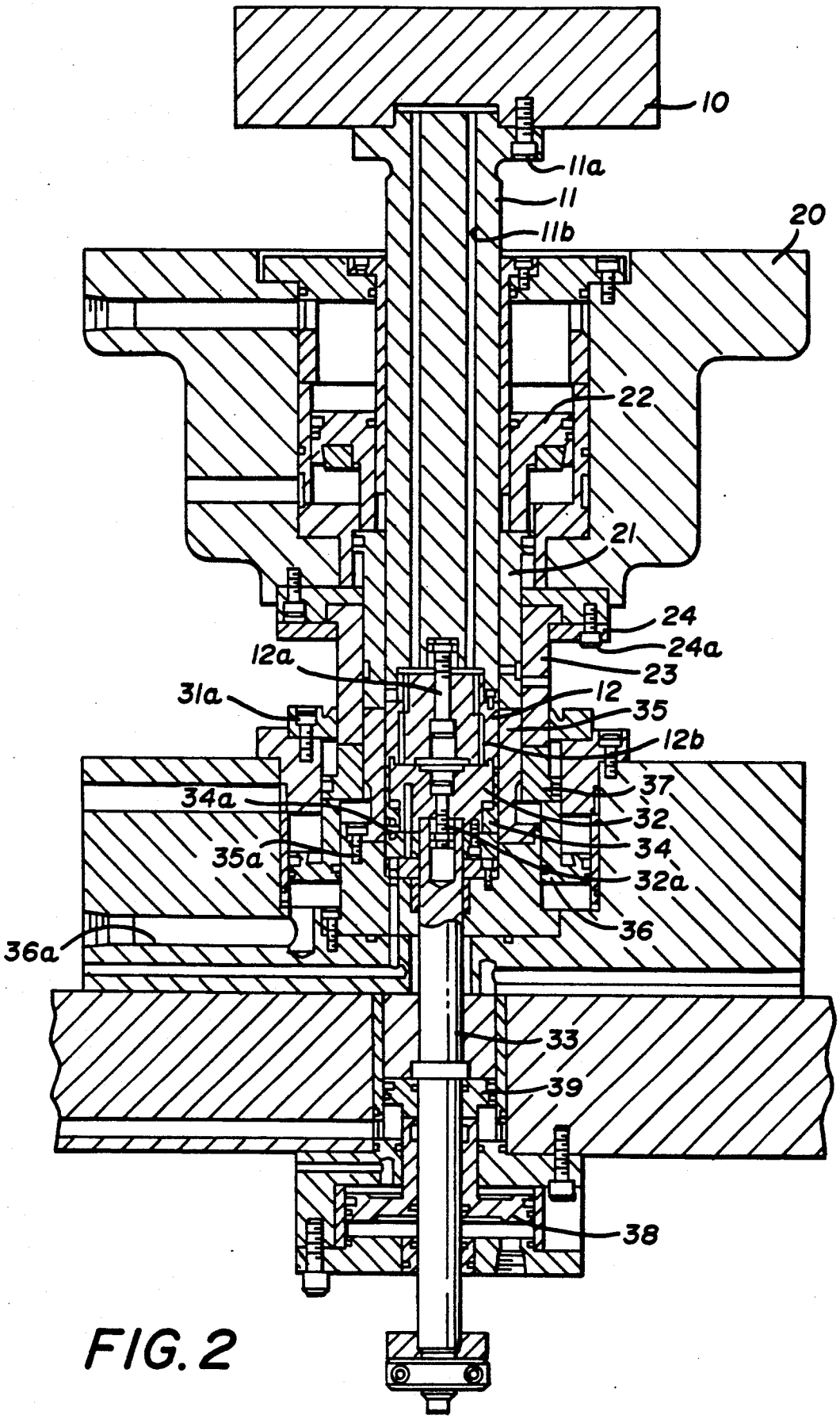
FIG. 2 is an elevational assembly view, partially in section, showing the position of the apparatus at the conclusion of the forming operation.

With that in mind and referring still to FIG. 1 of the drawings, it will be noted that the FIG. 1 position of the tooling is just prior to preliminary forming of the bottom profile of the container, while the FIG. 2 position of the tooling illustrates the position of the tooling following such forming. FIGS. 3 through 8 are enlarged views which illustrate the positions of the tooling at various stages of the forming operation.

Reference will then be had to FIGS. 1 or 2 for a general description of the apparatus and, in that regard, it will be noted that the inner ram of the press carries a inner slide holder 10 to which is attached a riser 11 by suitable screws 11*a*. The projecting end of the riser 11 carries a punch 12 secured thereto by screw 12*a* and which has a profiled bottom surface, for reasons which will become more apparent subsequently.

The outer ram of the press carries an outer slide holder 20 which is arranged generally in concentric relationship with respect to the riser 11 carried by the inner slide holder 10. Thus, surrounding the riser 11 is a pressure sleeve 21 which is reciprocal within the outer slide holder 20 and which is disposed beneath an upper piston 22 which is also reciprocal under fluid pressure through the bore 22*a* so that pressure acting on the piston 22 will act also on the sleeve 21 for purposes which will be described below.

Also carried on the outer slide holder 20 is a die cut edge 23 and a cut edge retainer 24 secured to the slide holder by means of suitable screws 24*a*.

Disposed in opposed relationship to the inner and outer slide holders 10 and 20 of the press is the fixed base or platen 30 which also carries a number of tooling components.

First, a cut edge 31 is secured to the base 30 by means of suitable screws 31*a* and cooperates with the die cut edge 23 for blanking the material, as will be described.

Inboard of the cut edge 31 is a profile pad 32 which is located centrally in the die cavity in the fixed base 30. This profile pad 32 is fixed to a die core riser 33 which is actuated by pistons 38 and 39 and can reciprocate with respect to the fixed base 30. Profile pad 32 also has a through vent passage 32*b* permitting venting to the atmosphere for purposes which will be described below.

Outboard of the profile pad 32 and die core riser 33 and inboard of the cut edge 31 is a knockout 34 which is supported by one or more springs 34*a* received in a fixed seat in the fixed base 30 so that, in effect, the knockout 34 is spring-loaded, again for purposes which will be described in detail below.

Also arranged concentrically about the profile pad 32 and die core riser 33 is a redraw die 35 which is fixed to the fixed base or platen 30 by one or more screws 35*a*. Concentric with the redraw die 35 and inboard radially of the cut edge 31 is a lower piston 36 which is actuated by a source of high fluid pressure through the bore 36*a*. Supported on the top of the lower piston 36 is a draw pad 37 which cooperates with the die cut edge 23, as again will be described below in greater detail.

Figure 3:
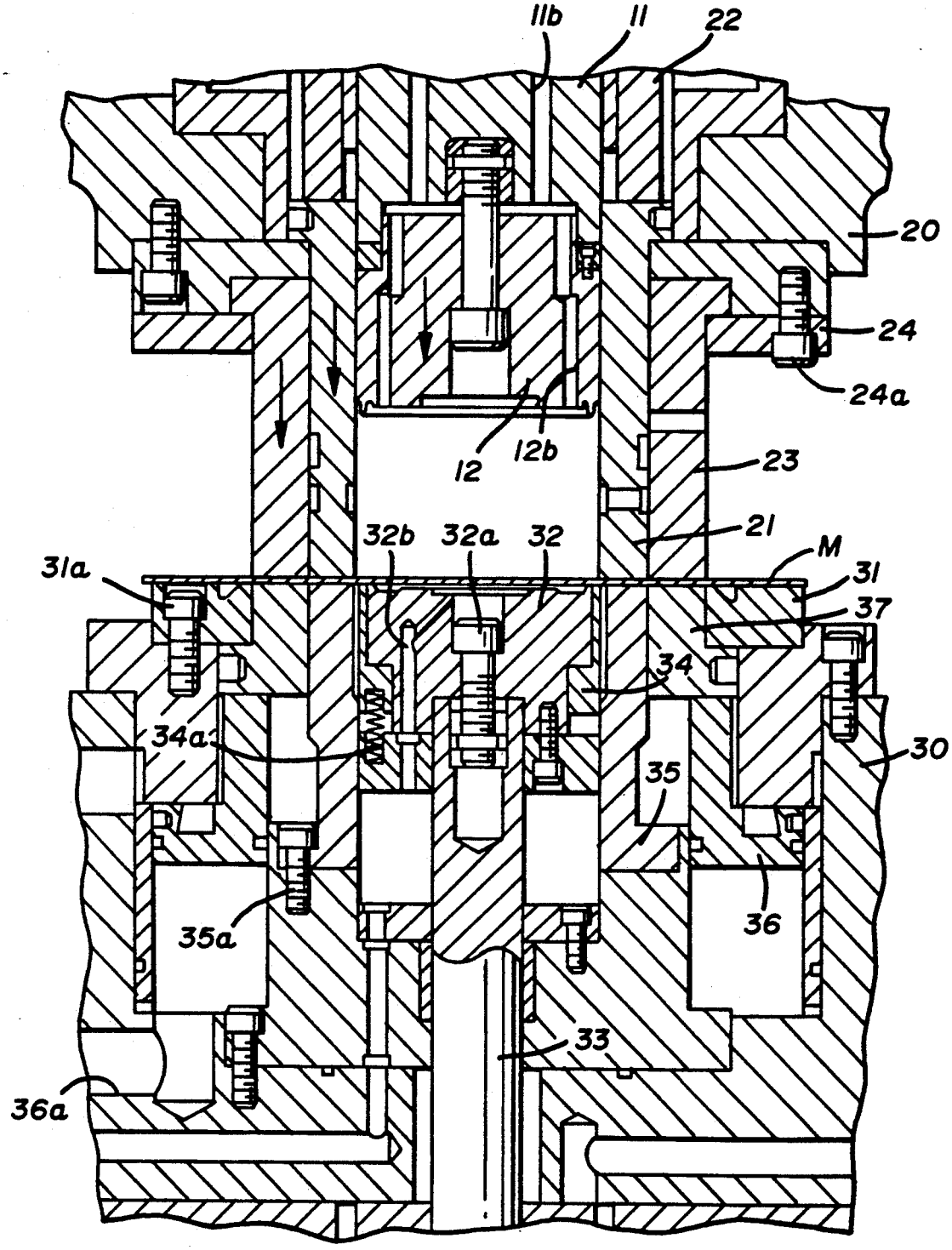
FIG. 3 is an enlarged sectional elevational view showing the position of the apparatus just prior to the blanking operation.

Turning next then to FIGS. 3 through 8, wherein enlarged elevational views are presented, for a description of the operation of the apparatus, and referring first to FIG. 3, it will be noted that the material M has been fed into the opening of the press in the form of either sheet or coil stock and is in position in FIG. 3 for the blanking operation.

At this time, both the inner and outer slide holders 10 and 20 are descending toward the base 30, and the die cut edge 23 has come in contact with the material M, as has the pressure sleeve 21, under the force of the piston 22. At this point, it will be noted that the lower piston 36 is in an elevated position such that the draw pad 37 is supporting the material M beneath the die cut edge 23. Additionally, the fixed redraw die 35 supports the material beneath the pressure sleeve 21.

Figure 4:
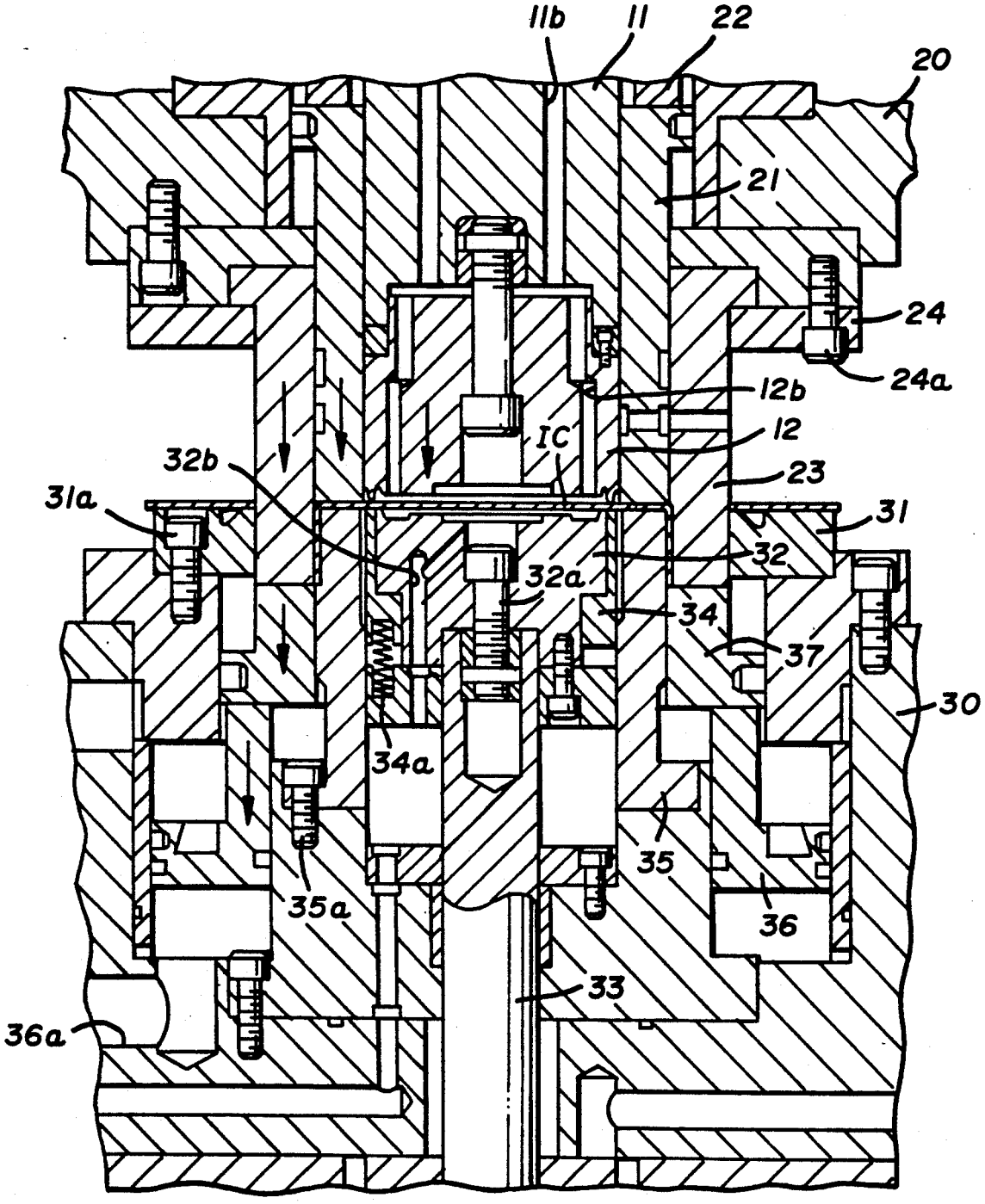
FIG. 4 is an enlarged sectional elevational view showing the position of the apparatus following formation of an inverted cup.

Further downward movement of the slide holders 10 and 20 moving the tooling from the position of FIG. 3 to FIG. 4 will accomplish two purposes.

First, the die cut edge 23 will sever the material M against the cut edge 31 so as to effectively blank the material. Second, continued downward movement of the die cut edge 23 will wipe the periphery of the blank thus formed about the top of the redraw die 35 to form an inverted cup IC from the blank, as can further be seen in FIG. 4 of the drawings. It will be noted at this point that the profile pad 32 is disposed beneath the central part of the inverted cup thus formed and is supported by air pressure under piston 39. Any air trapped beneath the material M will be exhausted through vent passage 32*b*. Furthermore, the punch 12 will have just come into engagement with the top of the material M at this stage.

Figure 5:
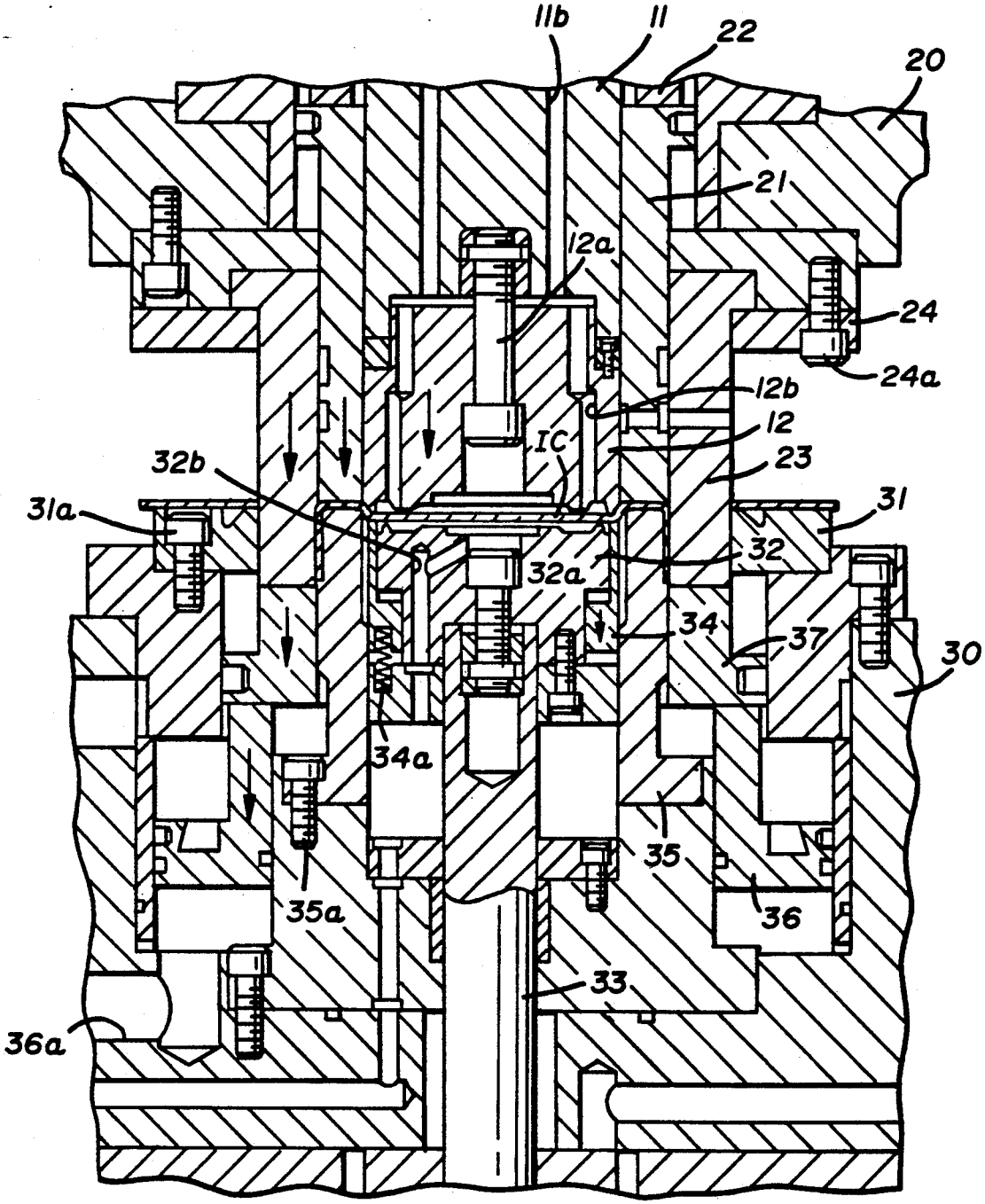
FIG. 5 is an enlarged sectional elevational view showing the position of the apparatus at the beginning of the reverse draw.

Continued downward movement of the slides 10 and 20 will move the tooling from the position of FIG. 4 to the position of FIG. 5 and will accomplish the object of initiating the redraw and inversion of the cup IC. It will be understood that the fluid pressure on profile pad 32 exerted by piston 39 is such that no profiling will initially take place. The high points on the bottom of punch 12 and top of profile pad 32 will contact the material and the punch will force the profile pad down and begin the reverse draw of the cup, as can be seen in FIG. 5.

Continued downward movement of punch 12 eventually causes piston 39 to "pick up" piston 38 (See FIG. 2). At this time, the high pressure on piston 38 will be sufficient to cause the bottom to be profiled by punch 12 and profile pad 32.

Figure 5A:
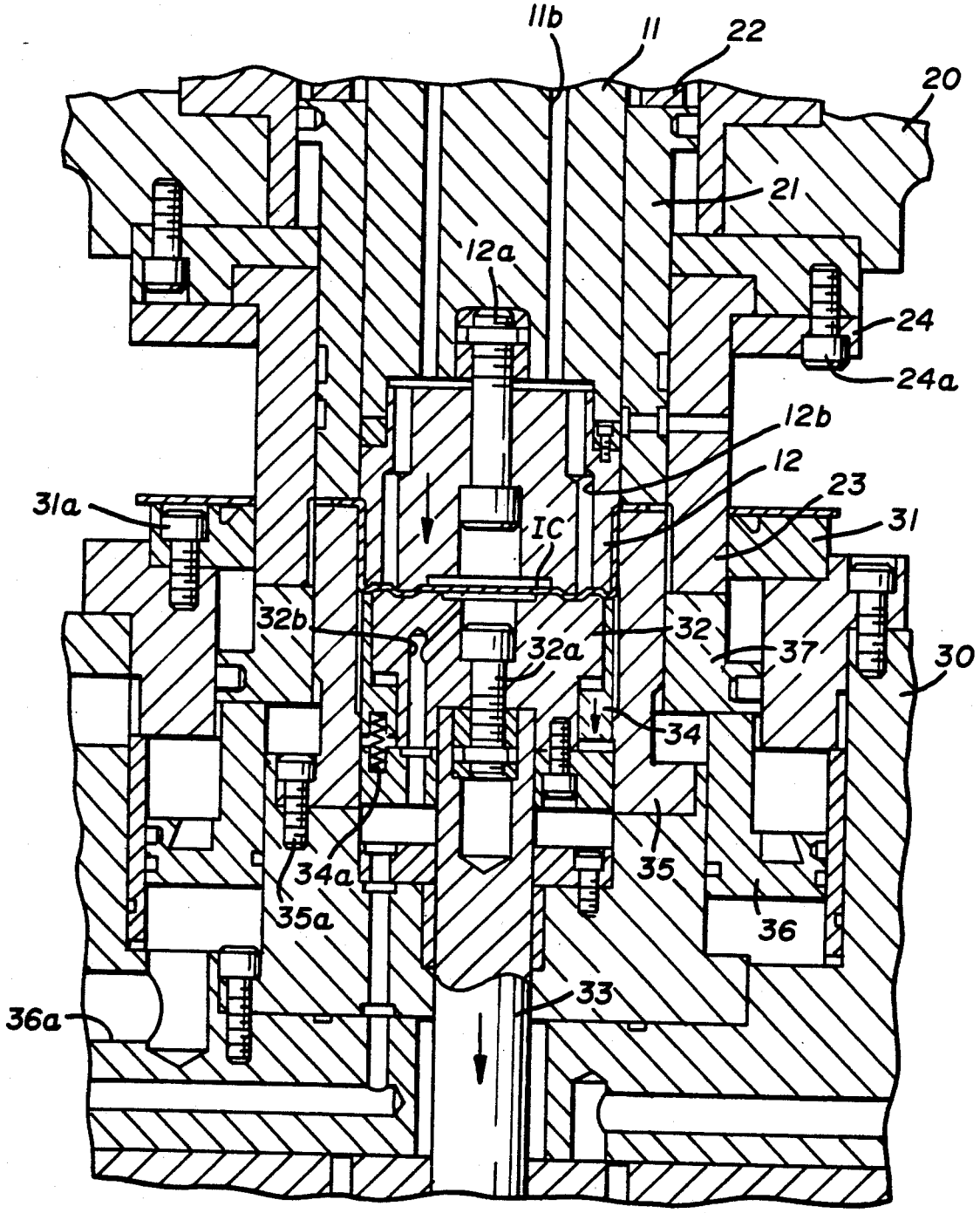
FIG. 5A is an enlarged sectional elevational view showing the position of the apparatus during the reverse draw and bottom profiling.

Thus, continued movement of the slide 10 toward the fixed base or platen 30 will force the riser 11 and the punch 12 downward against the material in the bottom of inverted cup IC and will impart the desired contour to the bottom, as can clearly be seen in FIG. 5A. It will be understood that this profile will be dictated by the complemental configuration of punch 12 and profile pad 32.

This movement will also force knockout ring 34 downward against the force of the spring 34a, compressing it. Movement of the slide 20 downwardly will also cause the die cut edge 23 to force the draw pad 37 and piston 36 downwardly, overcoming the fluid pressure beneath the piston 36. At this point, an inverted cup has been formed and the preliminary bottom profile has essentially been imparted to the container.

Figure 6:
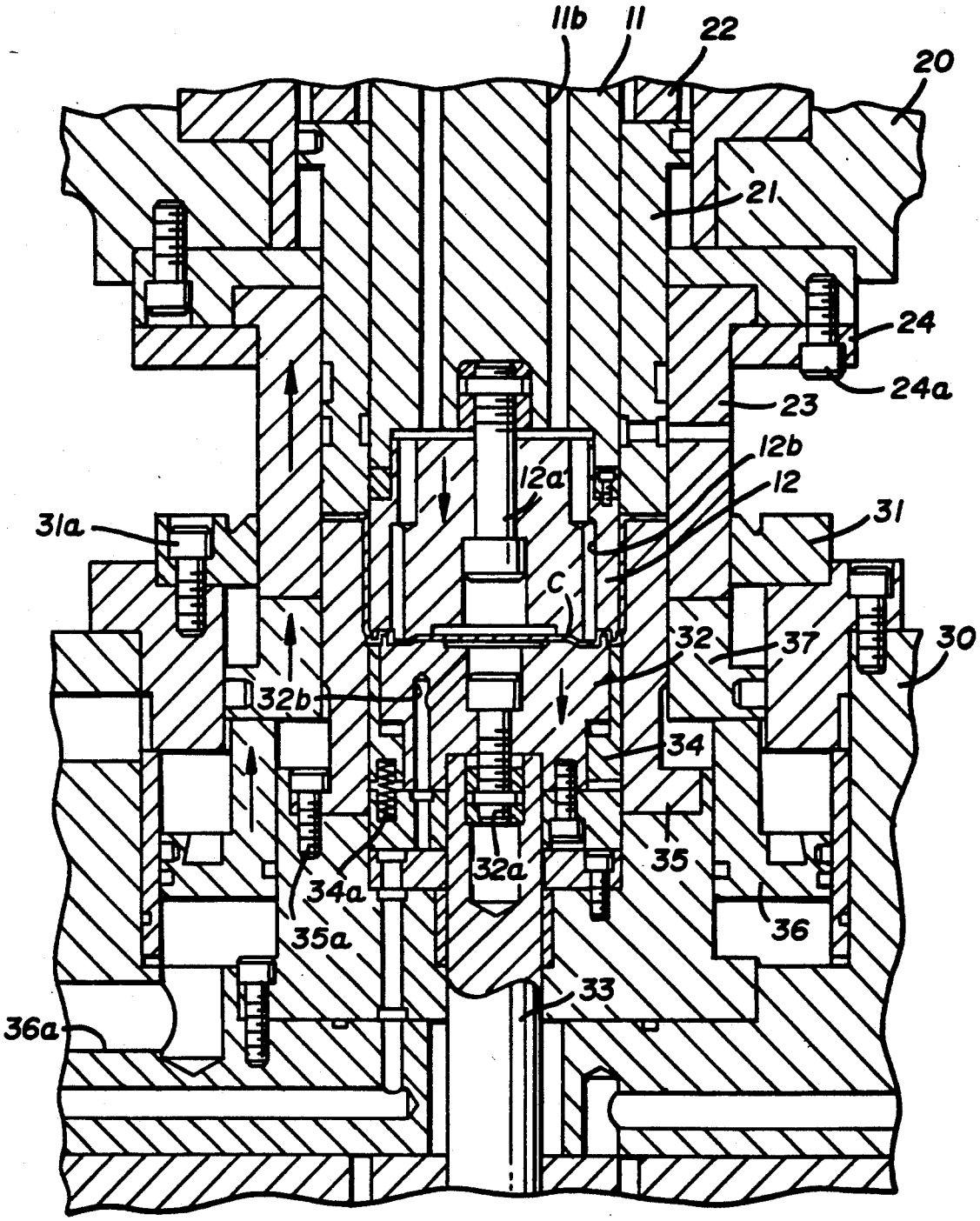
FIG. 6 is an enlarged sectional elevational view showing the position of the apparatus following reverse drawing and preliminary bottom profiling of the container.
Figure 7:
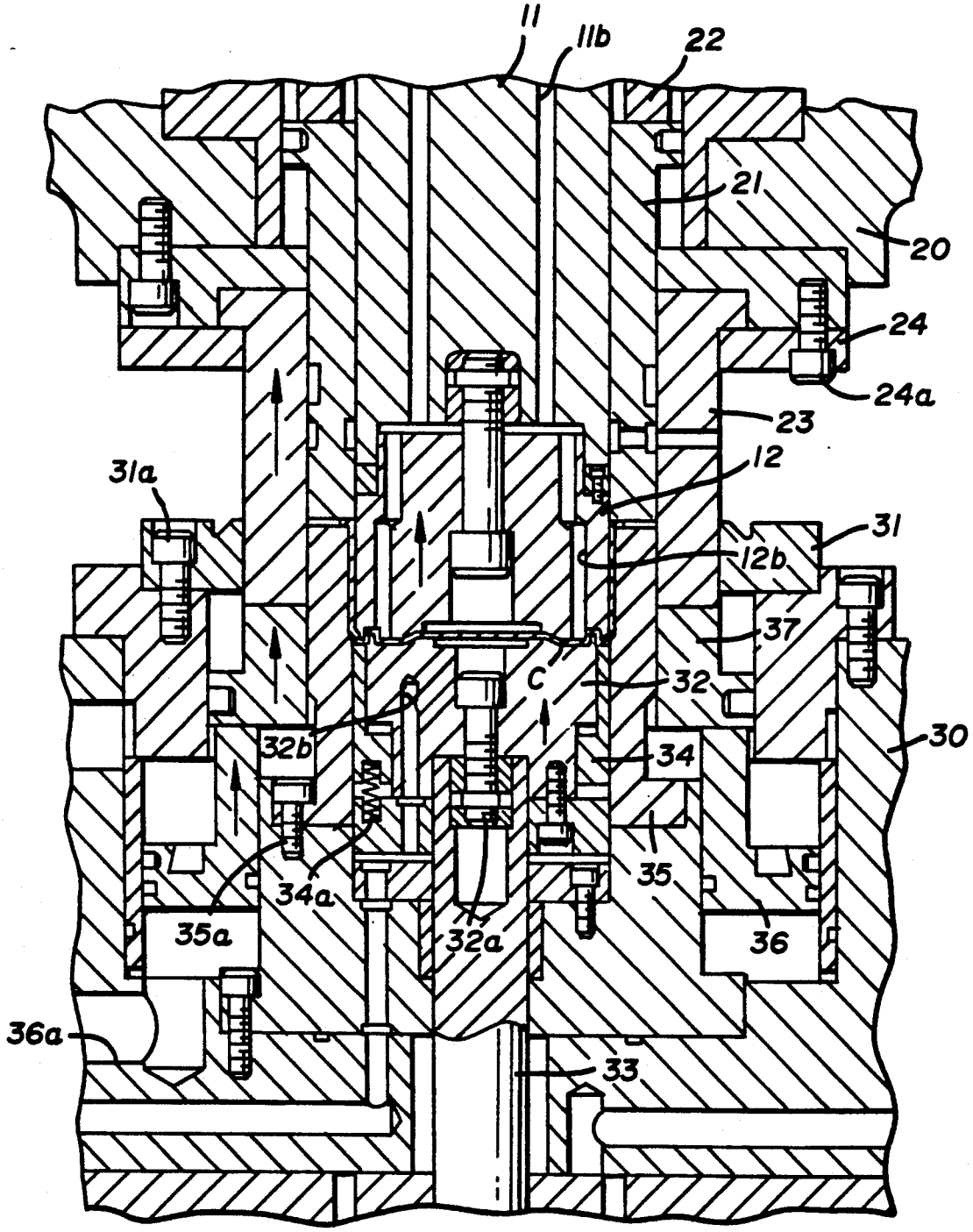
FIG. 7 is an enlarged sectional view showing the position of the apparatus at the start of reforming of the bottom profile.

Comparing the position of the tooling in FIGS. 5 and 6 (FIGS. 1 and 2, respectively), it will be noted that between those two positions, the outer slide holder 20 will have reached bottom dead center and will have begun to retract. It will then be noted that the die cut edge 23 will begin to pull away from the fixed base or platen 30. However, the inner slide 10 continues downward movement against the fluid pressure on piston 39 which now is picked up by piston 38 (See FIG. 2) thereby increasing resistance and will complete reverse of the container without disturbing the bottom profile established at the FIG. 5A position, pulling the material over the top of the die core ring 35 so as to effectively turn the previously formed cup IC inside out and form cup C.

As the inner slide 11 begins to pull away from base 30, the profile will be finally set. Following this, profile pad 32, under the influence of pistons 38 and 39, will roll material up into the bottom of the container and finally set the profile.

Figure 10:
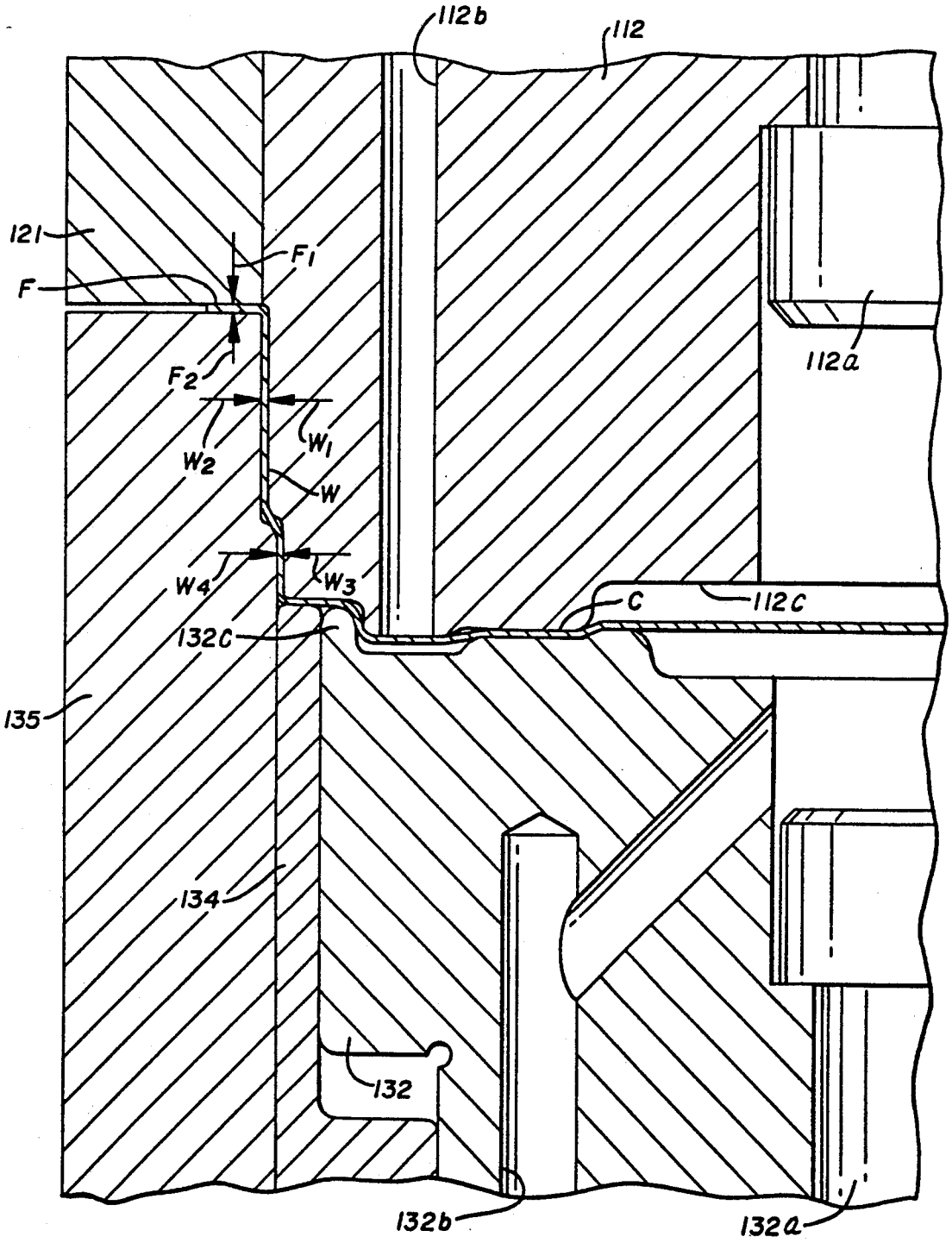
FIGS. 10 through 12 are enlarged sectional elevational views illustrating a modified form of the invention during the reforming operation.
Figure 11:
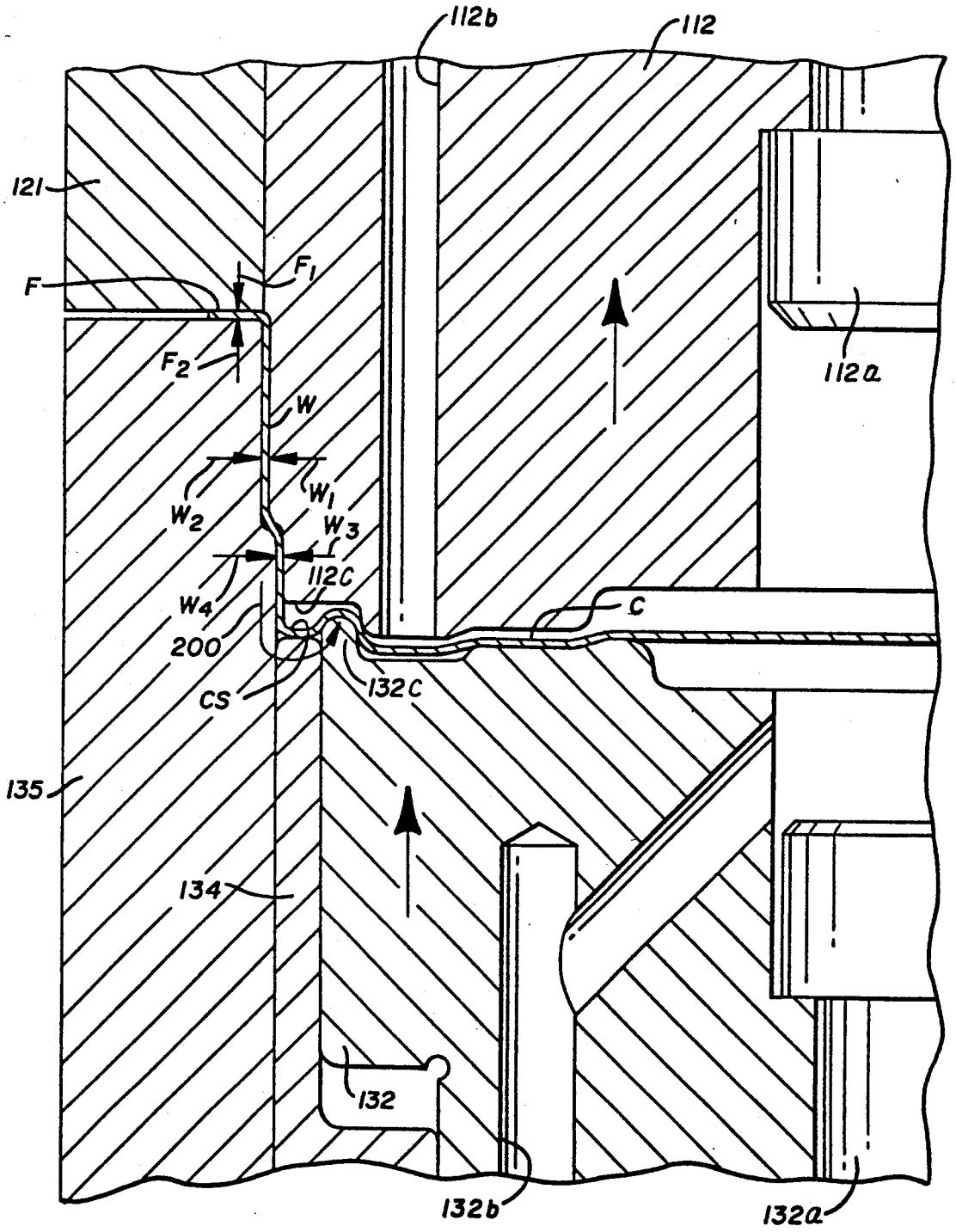
Figure 12:
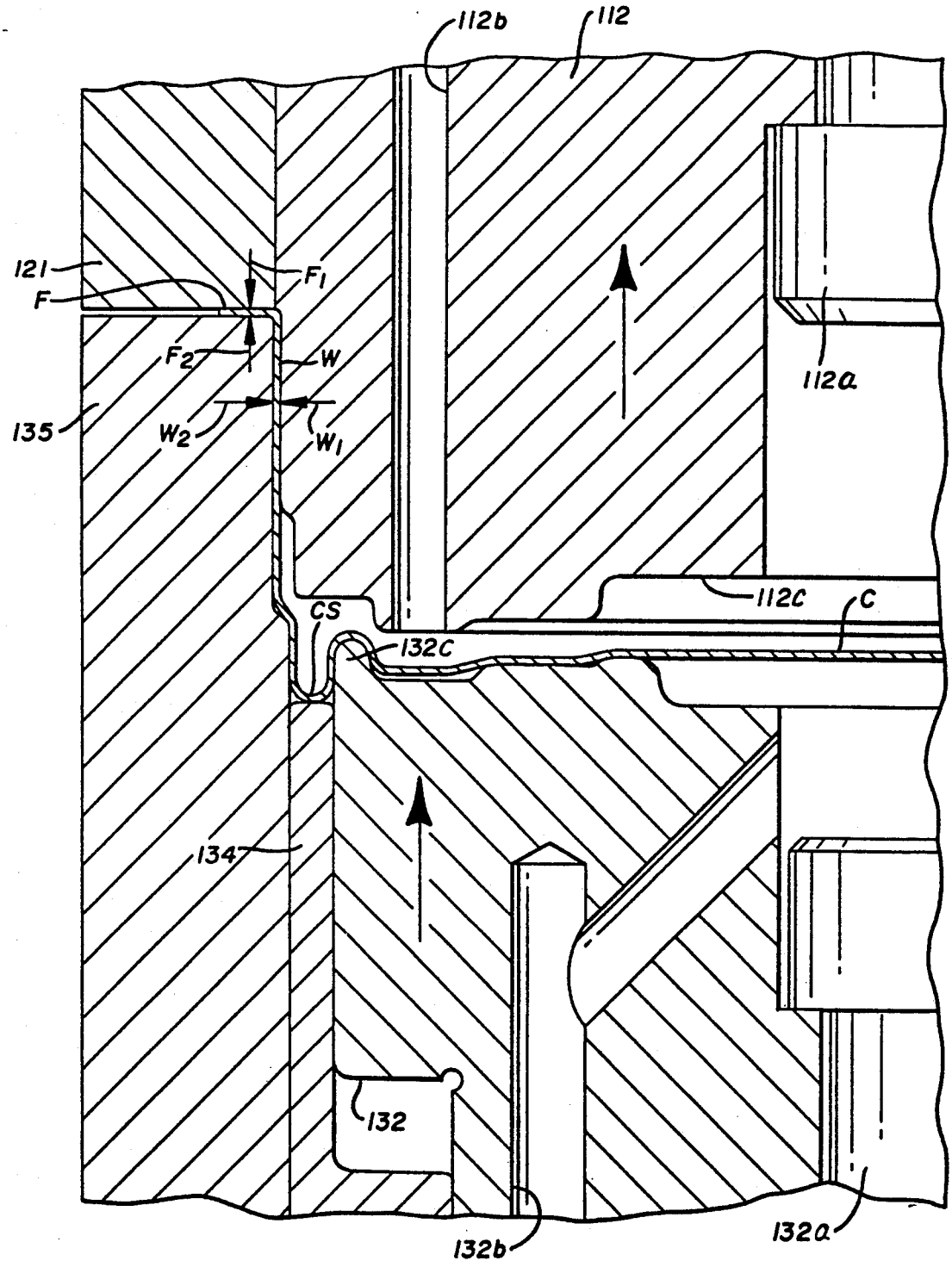

The reforming operation just described can perhaps be more clearly seen with reference to FIGS. 10 through 12 of the drawings wherein similar tooling components are identified by similar numbers in the 100 series.

Actually, the tooling components, such as the pressure sleeve 121, the redraw die 135, the knockout ring 134 and the profile pad 132, have configurations similar to the configurations illustrated in FIGS. 1 through 8 of the drawings. The only variance is with regard to the punch 112.

In FIGS. 1 through 8, the punch 112 is shown having an annular nose on its bottom surface. It will be noted from an examination of FIG. 10 that the bottom surface **112*c* of the punch 112** lacks this feature.

FIG. 10 of the drawings represents the tooling in a position comparable to that of FIG. 5A of the drawings. In other words, the container has been formed and a preliminary profile has been imparted to its bottom surface. At that point, the container C includes a flange F which is held between the sleeve 121 and the redraw die 135 with pressure being applied at the points indicated by the arrows identified as $F_1$ and $F_2$.

The sidewall area W of the container is trapped between the peripheral wall of the punch 112 and the die core ring 135 at points designated by arrows identified as $W_1$ and $W_2$ and $W_3$ and $W_4$.

Moving from the FIG. 10 position to the FIG. 11 position, it will be noted that the punch 112 will have started to pull away. The profile pad 132, however, also has started upward movement.

Keeping in mind that the flange F and the wall W remain clamped during this time, the annular nose **132*c* on the profile pad 132 will begin to pull material in the direction of the arrow 200 to preliminarily form the countersink radius CS. In effect, the metal is rolled up into the gap or recess between the top of the profile pad 132 and the bottom 112*c* of the punch 112**. At the same time, the clamping forces indicated by the arrows $F_1$ and $F_2$ hold the flange, and the metal is controlled in the sidewall area W in the areas indicated by the arrows $W_1$ and $W_2$ and $W_3$ and $W_4$.

Further moving to the FIG. 12 position, it will be seen that the punch 112 has pulled away and the nose **132*c* of the profile pad has finally profiled the bottom and has effectively shortened the wall area W. This is accomplished by the fact that the flange F is clamped during this time and the material is controlled in the wall area W. Therefore, upward movement of the profile pad 132 will roll the material into the configuration shown in FIG. 12 of the drawings. Following this, the operation of the apparatus is identical whether the version of FIGS. 1 through 8 or the tooling configuration of FIGS. 10 through 12** is employed.

Thus, once piston 38 engages the bottom of base 30, the profile will be finally set. Following this, piston 39 has sufficient pressure beneath it to lift the container back to the die line.

Figure 8:
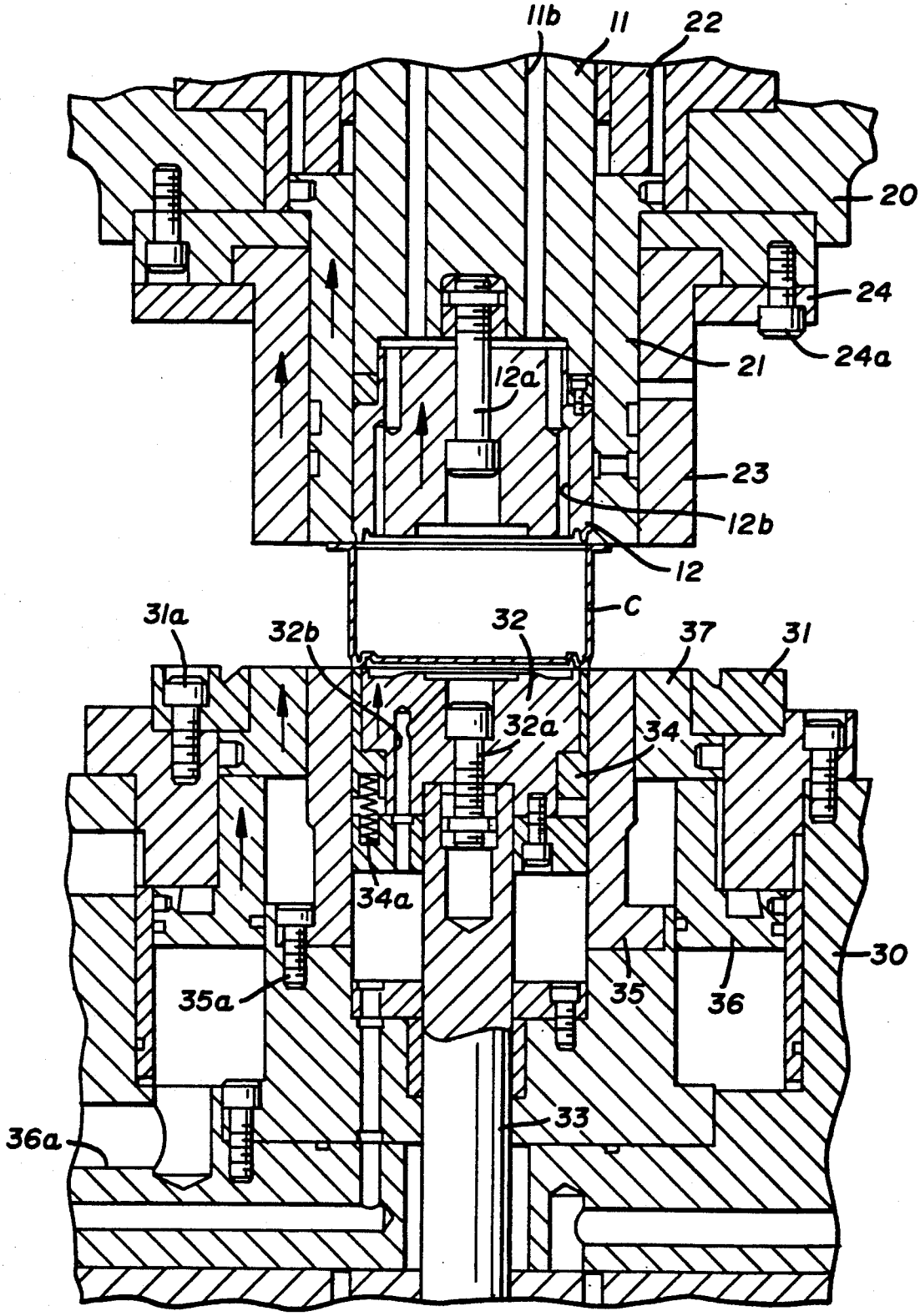
FIG. 8 is an enlarged sectional elevational view showing the position of the apparatus following completion of the container.
Figure 9:
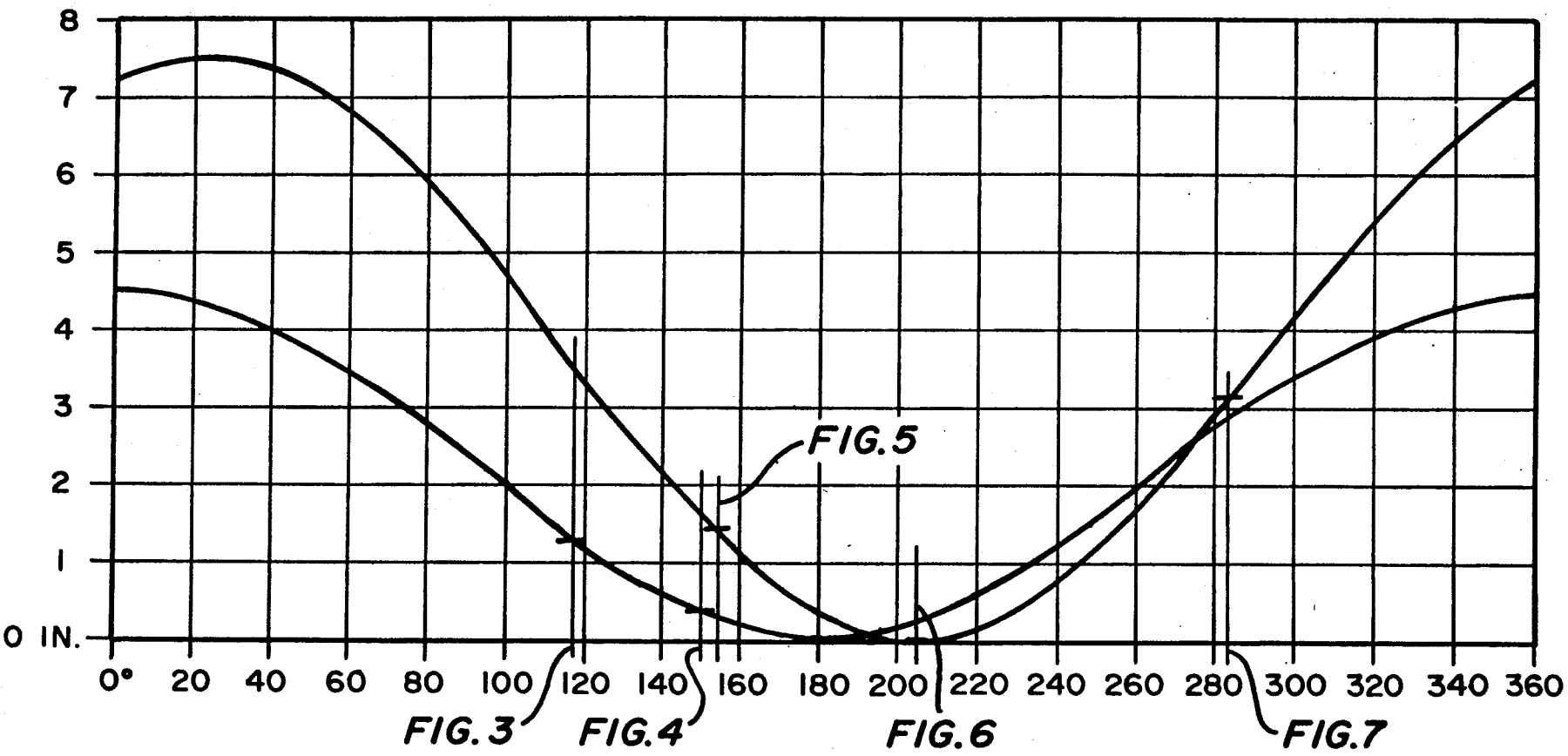
FIG. 9 is a timing diagram indicating the phase angles of the press at various stages of the operation.

The result of this action can be seen in FIG. 8 of the drawings wherein the die core riser 33 will have lifted the profile pad 32 back up to the die line and, of course, pulling the punch 12 away from the fixed platen will permit the spring **34*a* to raise the knockout 34 back up to die line, while piston 39 lifts profile pad 32 thereby assisting in removal of the container from the die cavity. It will be noted that profile pad 32 stops short of the die line and the action of springs 34*a* on knockout 34 is required to lift the finished container off the top of profile pad 32. Removal from punch 11 can then be accomplished by air pressure through passages 11*b* and 12*b*** or by other means if desired.

It will thus be seen that the method and apparatus just described is capable of forming a deep bottom profile at a single station and with a relatively tight radius and deep countersink.

While a full and complete description of the invention has been set forth in accordance with the dictates of the Patent Statutes, it should be understood that modifications can be resorted to without departing from the spirit hereof or the scope of the appended claims.

What is claimed is:

1. A method of forming a container body from a supply of material at one forming station, comprising the steps of:

A) forming a blank from the supply of material;

B) drawing an inverted cup from said blank;

C) reverse drawing said inverted cup to form a flanged cup with an overlength sidewall which interconnects a flange with a bottom wall and forming a preliminary profile in the bottom wall of said inverted cup during the reversal;

wherein step C includes first advancing a profiled punch against a profile pad supported by a low pressure piston and traveling said punch and said piston together; and second, engaging said low pressure piston with a high pressure piston disposed beneath said low pressure piston and continuing travel of said punch and said pistons to form the preliminary profile while holding pressure on the cup flange and D) reforming the preliminary profile to a final profile by rolling material from the overlength sidewall into the bottom wall to deepen the profile and shorten the sidewall.

2. The method of claim 1 wherein step C is accomplished by advancing a profiled punch into engagement with the bottom of said inverted cup and urging the bottom against a profile pad supported by a first fluidly suppported piston.

3. The method of claim 2 wherein the reforming portion of step D is accomplished by exerting force on said profile pad and said first piston by a fluidly supported second piston disposed beneath said first piston.

4. The method of claim 1 wherein travel of said punch is reversed and pressure on the cup flange is relieved.

5. The method of claim 1 wherein travel of said punch is reversed and pressure is maintained on the cup flange whereby upward movement of said pistons reforms the profile.

* * * * *